US006990776B2

(12) United States Patent
Berman

(10) Patent No.: US 6,990,776 B2
(45) Date of Patent: Jan. 31, 2006

(54) WALL COVERING WITH HOLDER

(76) Inventor: Oscar G. Berman, 3918 E. Ash La., Orange Village, OH (US) 44122

( * ) Notice: Subject to any disclaimer, the term of this patent is extended or adjusted under 35 U.S.C. 154(b) by 97 days.

(21) Appl. No.: 10/349,251

(22) Filed: Jan. 22, 2003

(65) Prior Publication Data

US 2004/0074177 A1 Apr. 22, 2004

Related U.S. Application Data

(60) Provisional application No. 60/351,577, filed on Jan. 25, 2002.

(51) Int. Cl.
*E04F 19/00* (2006.01)
*E04F 19/02* (2006.01)

(52) U.S. Cl. ..... 52/311.1; 52/287.1; 52/288.1; 52/716.1; 52/312; 52/290; 52/DIG. 13; 52/718.01; 52/718.04

(58) Field of Classification Search ..... 52/255, 52/287.1, 288.1, 716.1–717.06, 311.1–311.3, 52/312, 511, 290, DIG. 13, 261, 718.01, 52/718.04
See application file for complete search history.

(56) References Cited

U.S. PATENT DOCUMENTS

| | | | | |
|---|---|---|---|---|
| 3,302,350 | A * | 2/1967 | Brown et al. | 52/288.1 |
| 3,475,871 | A * | 11/1969 | Polimeni et al. | 52/273 |
| 3,977,112 | A * | 8/1976 | Breer, II | 40/760 |
| 5,088,252 | A * | 2/1992 | Antekeier | 52/287.1 |
| 5,598,681 | A * | 2/1997 | DiGianni | 52/717.05 |
| 6,385,939 | B1 * | 5/2002 | Stout | 52/718.01 |
| 6,393,784 | B1 * | 5/2002 | Antekeier | 52/287.1 |
| 6,401,418 | B1 * | 6/2002 | Senn et al. | 52/506.01 |
| 6,557,311 | B1 * | 5/2003 | Mongelli | 52/288.1 |
| 6,655,101 | B2 * | 12/2003 | Harel | 52/287.1 |

* cited by examiner

*Primary Examiner*—Jeanette E. Chapman
(74) *Attorney, Agent, or Firm*—D. Peter Hochberg; Sean Mellino; Katherine R. Vieyra

(57) ABSTRACT

The present invention provides a pasteless wall covering system in which wall covering becomes easily installable, removable, changeable and reusable without damaging walls. A wall covering border is attached to, or made from, a semi-rigid paper stock and is held on the wall by a holder with channels. The holder can be created by scoring and folding a top and bottom channel. The holder can be attached to the wall by stapling, adhesives or other attachment means.

12 Claims, 4 Drawing Sheets

WALL COVERING WITH HOLDER

This application claims the benefit of Provisional Application No. 60/351,577, filed Jan. 25, 2002.

BACKGROUND OF THE INVENTION

1. Field of the Invention

The present invention relates generally to wall covering borders and layer sheets of wall covering that are attached to a wall without wallpaper paste or other type of adhesive, and more particularly to wall covering borders and wall covering in general that are attached to a wall by placing them into a channel or clip.

2. Description of Prior Art

Wall coverings are used to provide a decoration for walls. These coverings offer an alternative from painting by providing more decorative and design options. Wall coverings can also be used as borders or trim on walls, providing a touch of color or design on an otherwise plain wall surface. However, wall coverings, either full or borders, must be pasted or adhered to walls making them a permanent decoration. The result is that, when a wall covering is removed, the wall itself is often damaged, requiring it to be patched and repainted or recovered. Changing wallpaper, either as a trim or for a larger portion of a wall, is difficult since the old paper must be removed which is a time consuming and tedious process, and is generally frowned upon by the owners of residences, rental units, stores, offices or cottages where such changes are more likely to occur (or at least be more desirable) due to the change in tenants. Thus, owners of rental homes, apartments, offices and stores usually will not permit the renters or temporary dwellers to apply new wall coverings or change existing ones. There is a desire of building owners in particular, and of others who are responsible for changes in wall design, to have a pasteless wall paper system for changing wall paper without having to scrape off or otherwise remove old wallpaper before installing new wall paper. In addition, there is a desire for those decorating walls to have a fast and inexpensive way to change wall paper. Further, it is difficult to apply traditional wall coverings or wall borders to textured or non-smooth walls.

SUMMARY OF THE INVENTION

The present invention provides a solution to the problems of the prior art with a pasteless wall covering system in which wall covering becomes easily installable, removable, changeable and reusable without damaging walls. This invention will allow apartment and other rental property owners, such as store and office owners, to encourage tenants to change wall decorations to suit individual tenant's tastes, and will also enable tenants to easily install and change wall decorations on non-smooth or textured wall surfaces. The invention has particular advantages for wall covering borders but it can be used for larger sections of wall coverings as well. Further, it could be used with non-paper wall coverings such as fabric, carpeting, etc.

In accordance with a preferred embodiment of the present invention, a conventional wall covering border is attached to a semi-rigid paper type stock, or a decoration is printed onto a semi-rigid paper type stock, creating a semi-rigid wall covering border. Likewise, the semi-rigid paper stock can itself carry the decoration and form the border. A holder for the semi-rigid wall covering border is created by scoring and folding a channel that is stapled or otherwise attached to the wall surface at the desired wall covering border location.

An object of this invention is to provide an article that serves as a wall covering border or wall covering and is easy to install and change.

A further object of this invention is to provide an article that serves as a wall covering border or wall covering and is interchangeable.

A further object of this invention is to provide an article that serves as a wall covering border or wall covering and does not damage the wall surfaces when removed.

Yet another object of this invention is to provide an article that serves as a wall covering border or wall covering and can go over smooth or textured surfaces.

Yet another object of this invention is to provide an article that serves as a wall covering border or wall covering and is reusable.

Yet another object of this invention is to provide an article that serves as a wall covering border or wall covering and is inexpensive.

Yet another object of this invention is to provide an article that serves as a wall covering border or wall covering and has no pattern matching required.

Yet another object of this invention is to provide an article that serves as a wall covering border or wall covering and is supplied in a continuous roll.

Still another object is to provide a wall paper system for providing a pasteless or adhesiveless wall paper that can be easily and quickly changed.

These and other objects will become apparent from the following description of a preferred embodiment taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF THE PREFERRED EMBODIMENT

Figures 1, 2, 2A, 3, 3A:
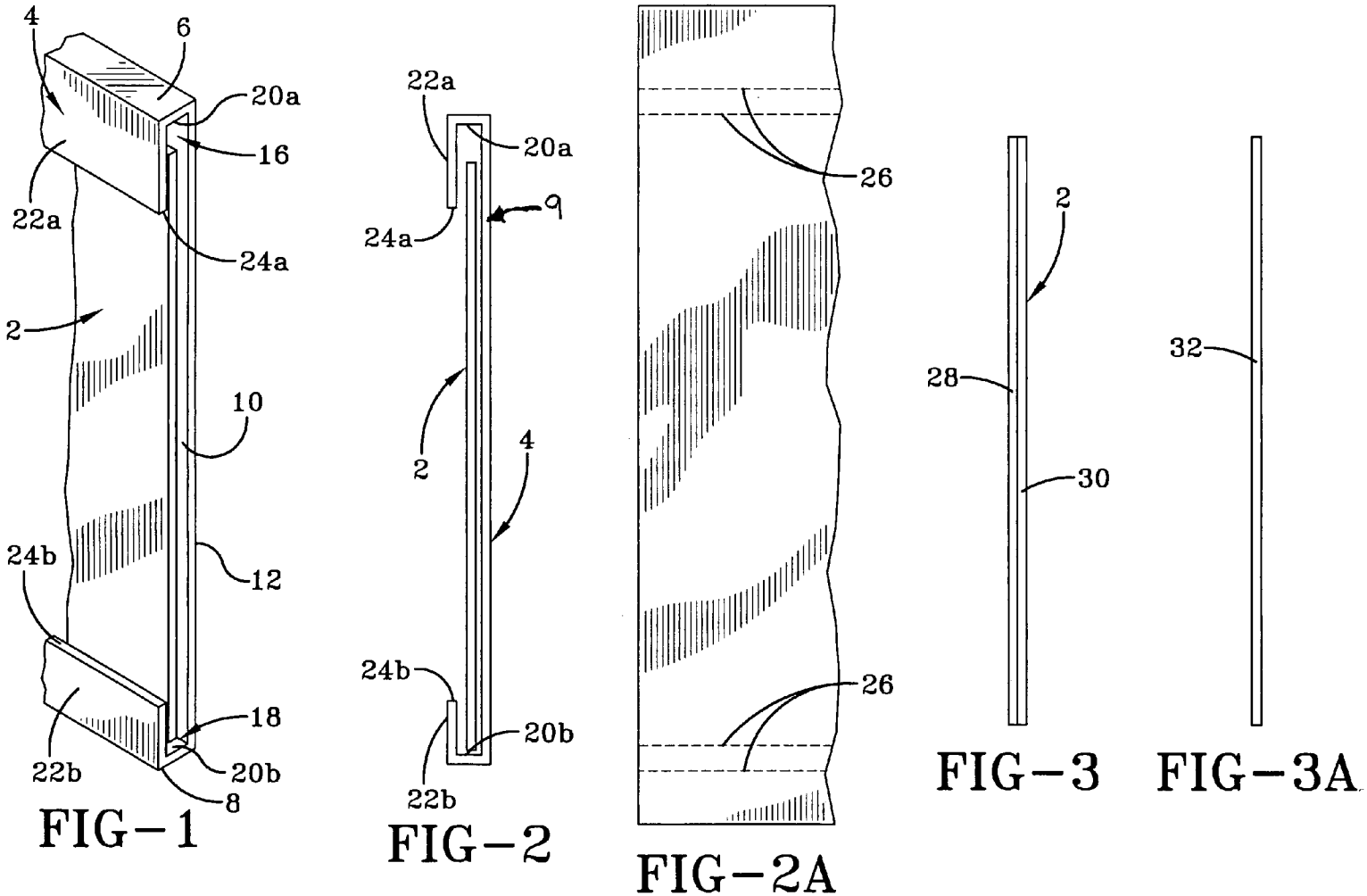
FIG. 1 is an end perspective view of a wall covering border in a holder.
FIG. 2 is an end view of the wall covering border in the holder of FIG. 1.
FIG. 2*a* is a top view of the holder prior to folding the channels.
FIG. 3 is a side view of a two layer or two member wall covering border.
FIG. 3*a* is a side view of a one piece wall covering border.

Referring now to the drawings wherein the showings are for the purpose of illustrating the preferred embodiment of the invention only, and not for the purpose of limiting same, FIG. 1 and FIG. 2 show a wall covering border 2 in a holder 4. The holder 4 can be can preferably be made of PVC or other materials, can be flexible or made of flexible materials, and can preferably have a matte finish that does not reflect light. The length of the holder can be as short as about three feet. A preferred length can be between six and thirty feet. The holder 4 has a top longitudinal side 6, a bottom longitudinal side 8, and a support 9 including a front surface 10 and a back surface 12. The longitudinal sides 6, 8 of the holder 4 are folded over twice to form channels, top channel 16 and bottom channel 18, each having a base 20*a*, 20*b*, and a channel or fold lip 22*a*, 22*b* with a fold or channel edge 24*a*, 24*b*, extending along the length of the holder 4. The channels 16, 18 hold the wall covering border 2 when it is installed on the wall. As shown in FIG. 2*a*, the holder can be scored with score lines 26 in the front surface 10 so that it can be stored and distributed without channels and folded to create the channels 16, 18 at the installation site.

Numerous attachments means can be used to attach the back surface 12 of the holder 4 to a wall. Such means include hook and latch systems such as Velcro®, adhesives, double faced tape, staples, or glue. In a preferred embodiment, the top channel lip 22*a* is larger than the bottom channel lip 22*b*. In a preferred embodiment, the channel lips 22*a*, 22*b*, are biased in an inward direction, that is, the channel lips have "memory", so that they press against the wall paper border, holding the border firmly in place.

FIG. 3 shows the wall covering border 2 which is comprised of a top member 28 and a bottom member 30. The top member 28 can preferably be made of wall covering material, which can be from 2" to 30" wide, and, in one preferred embodiment, from 6¼" to 6¾" wide. The bottom member 30 can be made of a semi-rigid paper stock. The paper stock, or alternative material, should be flexible enough so that wall covering border 2 can be changed from a flat position to a roll for storing and transporting. The bias of the roll could help keep it in place in the holder. For the bottom member 30, a material having one side covered with pressure sensitive adhesive can be used to so that the bottom member 30 can be inexpensively and simply attached to the top member 28. In the alternative, as shown in FIG. 3*a*, the decoration can be placed directly on a semi-rigid paper stock 32.

Figure 5:
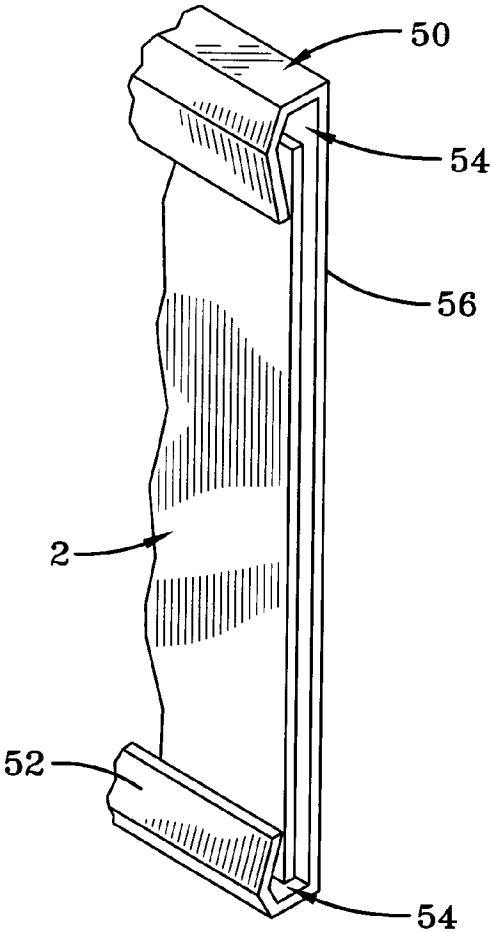
FIG. 5 is a perspective view of the wall covering border in a holder.
Figure 4:
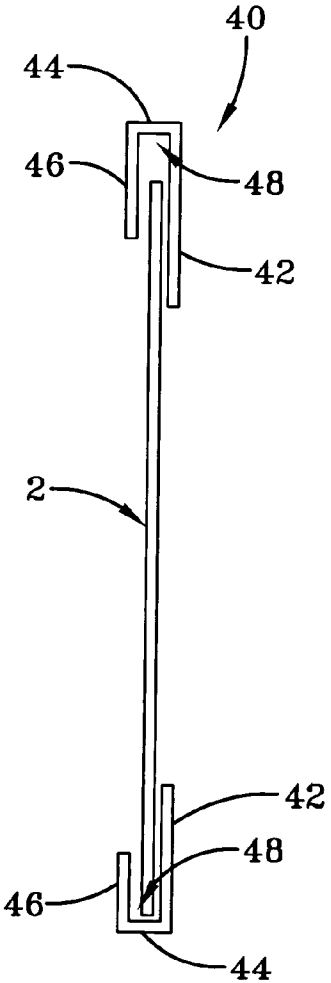
FIG. 4 is a side view of the two piece wall covering border in a holder.

FIG. 4 shows a second embodiment, wherein the holder 40 is separated into two pieces, each "J" shaped and having a back 42, an upper wall 44 and a front or top 46. A channel 48 is formed between the top 46 and the back 42 of the holder 40, there being two channels 48 for each assembly. FIG. 5 shows another embodiment, wherein the holder 50 can preferably be made of molded foam, channeled wood or other moldable, semi-rigid material. In the alternative, the holder 50 can be made of rigid or semi-rigid PVC with clear edges, similar to the material found in vertical blinds. The front 52 of the holder 50 can be rounded or angled. A pair of opposing channels 54 are formed between the front 52 and the back 56 of the holder 50.

Figure 6:
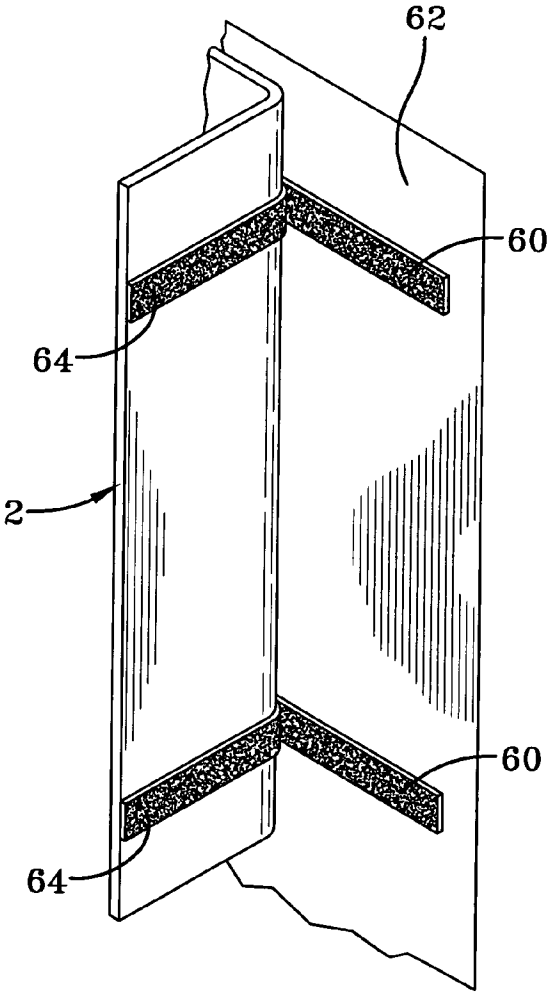
FIG. 6 is a perspective view of the wall covering border in a holder.

Another embodiment of the invention is shown in FIG. 6 in which the holder 60, attached to a wall 62, is the hook-type material of a hook and latch connecting system, such as Velcro, and the latch material 64 is attached to the back of the wall covering border 2. In the alternative, the holder 60 could be made of double faced adhesive tape.

Figure 7:
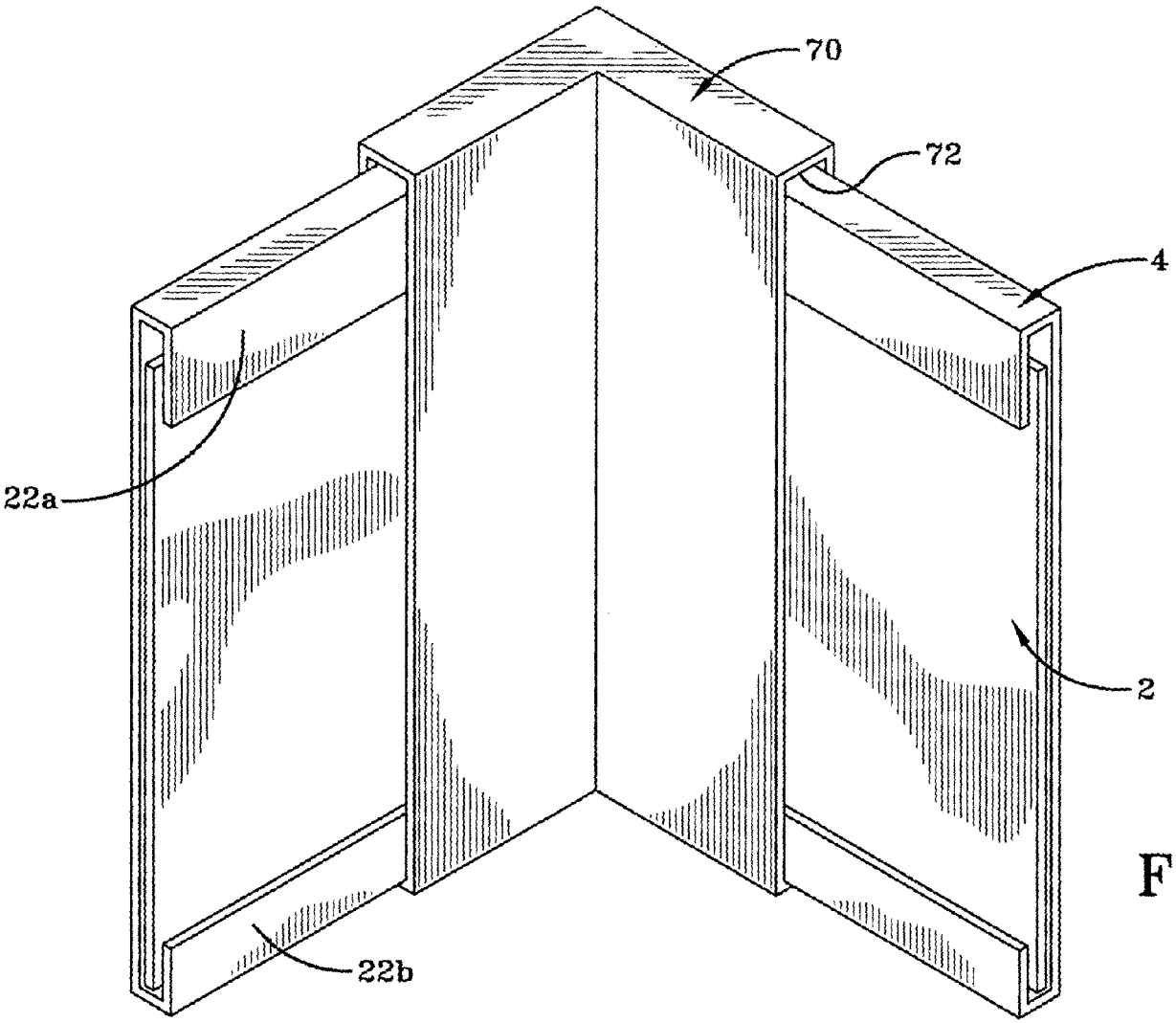
FIG. 7 is a front perspective view of an interior or exterior corner.

FIG. 7 shows a corner piece 70, which can be used at the junction of walls, typical inside corners as well as outside corners. These corner pieces can be made of rigid PVC vinyl, wood, foam, plastic or other materials. The holder 4 and wall covering border 2 can be applied to each wall forming the juncture and the corner piece 70 can be inserted into the corner, abutting holder. In the embodiment shown in FIG. 7, the corner piece can contain slots 72 into which the wall covering border 2 can be inserted. In the alternative, the wall covering border may abut the corner piece. In a preferred embodiment, the wall covering border 2 and holder 4 may be bent to wrap the corner; no special corner piece would be necessary.

Figure 8:
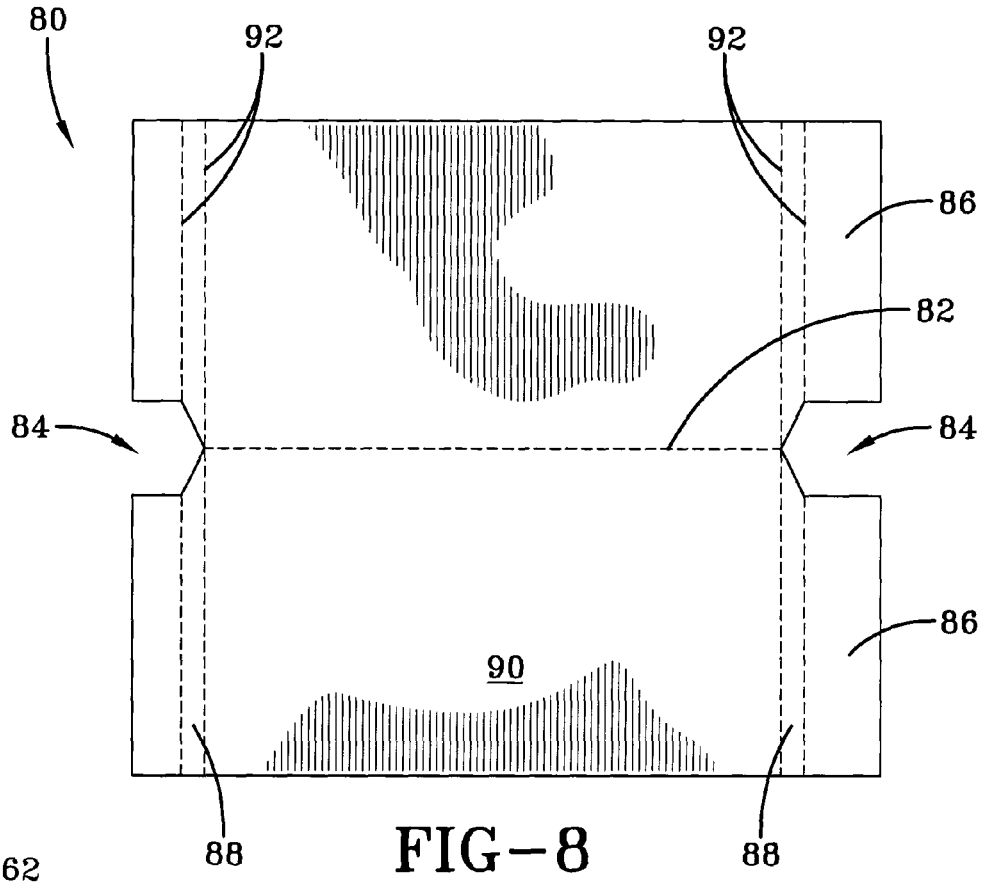
FIG. 8 is a top view of the wall covering border corner piece.
Figure 9:
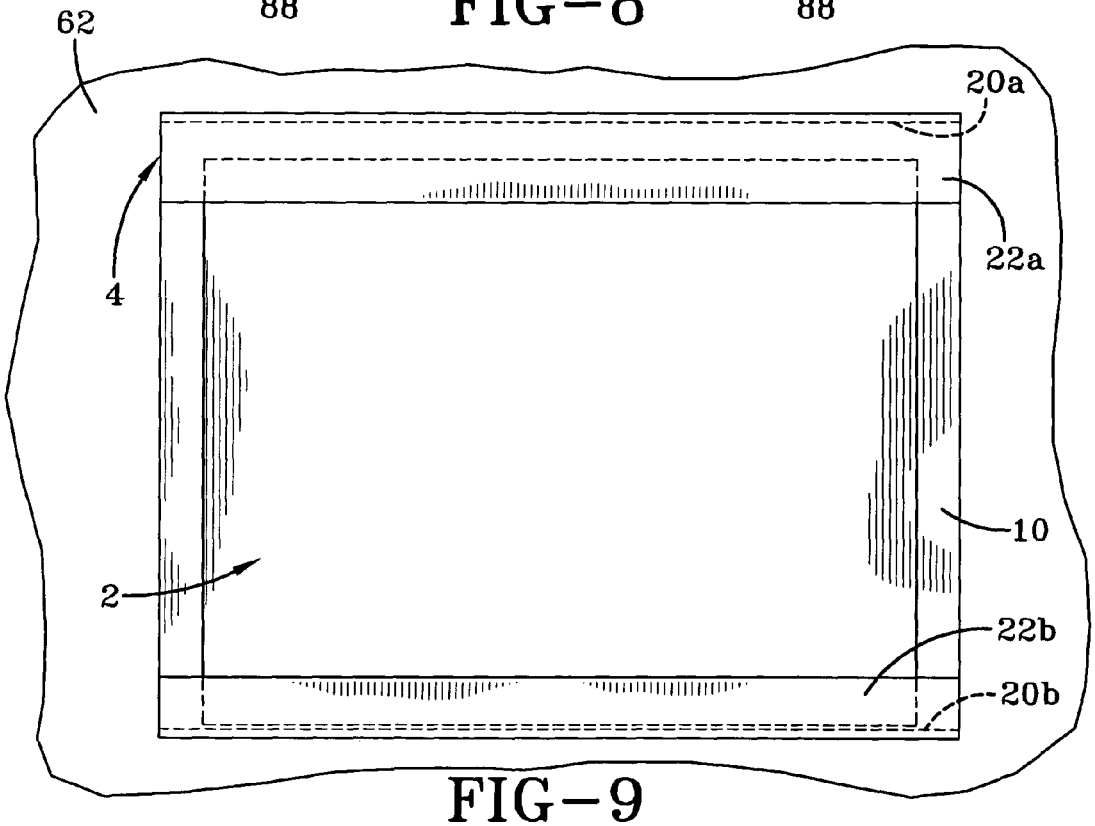
FIG. 9 is a front perspective view of a wall covering border in a holder on a wall.

FIG. 8 shows a corner piece 80 which can be used in a non-square corner, that is, a corner that is not 90°. This corner piece 80 has a center score-line 82 along which it can be bent or folded, creating the desired corner angle. In addition, a channel 84 is formed between the top 86, the side 88 and the back 90 of the corner piece 80, there being two channels 84 for each corner piece 80. The top 86 and the side 88 of the channel 84 do not extend the entire length of the wall covering border holder; instead, each terminates before reaching the score-line 82, enabling the corner piece to bend and form the corner angle. There are vertical score-lines 92 along which the corner piece can be folded to create the top and the side of the channel.

Installation of the current invention is easy. In the embodiment shown in FIGS. 1 and 2, channels 16, 18 are created by folding the holder 4 along the scored lines 26. In all of the embodiments, the holder 4, 40, 50, 60 is attached to the wall using fasteners such as clips, staples, or adhesives such as pressure sensitive adhesives and double faced tape. Key shaped holes can be made in the backs of the holder having an enlarged bottom portion and a narrow top portion. A screw or other fastener can be inserted in a wall with its top end extending outwardly from the wall, and the back of the holder can be placed so that the head of the fastener extends through the enlarged bottom portion hole. The holder can then be released so that the fastener supports the holder through the upper edge of the narrow portion of the hole. Once the holder is secured on the wall, the wall covering border 2 is unrolled and inserted into the holder 4, preferably by sliding it into the channel 16, 18, 48, 54 along the wall. Corner pieces, which can be made of rigid PVC vinyl, wood, foam or plastic, can be used at the junction of walls. These corner pieces can contain slots into which the wall covering border can be inserted. Corner pieces can be used in typical inside corners as well as outside corners; in both cases, the channel 16, 18, 48, 54 and wall covering border 2 can be applied to each wall forming the juncture. The wall covering border 2 may wrap the corner, if it is pliable enough.

Changing the wall paper is very easy. The user simply grasps the end portion of the wall paper and withdraws it from the holder, and inserts a replacement wall paper by forcing it between the front and back of the holder.

The invention has been described with particular emphasis on the preferred embodiments. It should be appreciated that these embodiments are described for purposes of illustration only, and that numerous alterations and modifications may be practiced by those skilled the art without departing from the spirit and scope of the invention. It is intended that all such modifications and alterations be included insofar as they come within the scope of the invention or the equivalents thereof.

We claim:

1. A wall covering border comprising:

a base piece; and a decorated piece, said base piece having a top longitudinal side, a bottom longitudinal side, a support having a back surface for receiving attachment structure for attaching said support to a wall, and a front surface having score lines, said top longitudinal side being folded along said score lines to form a top channel extending the length of the base piece, said top channel having a top channel base and a top channel lip having a top channel edge, said bottom longitudinal side being folded along said score lines to form a bottom channel extending the length of the base piece, said bottom channel having a bottom channel base and a bottom channel lip having a bottom channel edge, said decorated piece resting on said bottom longitudinal side and being disposed in said top and bottom channels, and being viewable from between the separation between said lips, wherein said attachment structure is selected from the group consisting of adhesives, pressure sensitive adhesives, staples, double-faced adhesives and hook and latch systems, said top channel lip and said bottom channel lip being biased in an inward direction, securing said decorated piece, and wherein said base piece is made from flexible material, and a distance from said top channel edge to said top channel base is greater than a distance from said bottom channel edge to said bottom channel base, and said base piece is at least six feet long, and said apparatus for attaching said base piece to a wall is selected from the group consisting of adhesives, pressure sensitive adhesives, staples, double-faced adhesives and hook and latch systems, and said decorated piece is between 2" and 30" wide.

2. A wall covering border according to claim 1, wherein:

said decorated piece is between 6¼" and 6¾" wide.

3. A wall covering border according to claim 1, wherein:

said base piece is made from at least one of transparent plastic and polyester.

4. A wall covering border according to claim 1, wherein:

said decorated piece is comprised of a top member and a bottom member.

5. A decorated piece according to claim 4 wherein:

said top member is wall covering material and said bottom member is semi-rigid paper stock.

6. A decorated piece according to claim 4 wherein:

said top member and said bottom member are attached using pressure sensitive adhesive.

7. A wall covering border comprising:

a base piece; and a decorated piece, said base piece having a top longitudinal side, a bottom longitudinal side, a support having a back surface for receiving attachment structure for attaching said support to a wall, and said top longitudinal side being folded to form a top channel extending the length of the base piece, said top channel having a top channel base and a top channel lip having a top channel edge, said bottom longitudinal side being foled to form a bottom channel extending the length of the base piece, said bottom channel having a bottom channel base and a bottom channel lip having a bottom channel edge, said decorated piece resting on said bottom longitudinal side and being disposed in said top and bottom channels, and being viewable from between the separation between said lips, wherein said attachment structure is selected from the group consisting of adhesives, pressure sensitive adhesives, staples, double-faced adhesives and hook and latch systems, said top channel lip and said bottom channel lip being biased in an inward direction, securing said decorated piece, and wherein said base piece is made from flexible material, and said base piece is at least six feet long, and said apparatus for attaching said base piece to a wall is selected from the group consisting of adhesives, pressure sensitive adhesives, staples, double-faced adhesives and hook and latch systems, and said decorated piece is between 2" and 30" wide.

8. A wall covering border according to claim 7, wherein:

said base piece is made from at least one of transparent plastic and polyester.

9. A wall covering border according to claim 7, wherein:

said decorated piece is comprised of a top member and a bottom member.

10. A decorated piece according to claim 9 wherein:

said top member is wall covering material and said bottom member is semi-rigid paper stock.

11. A decorated piece according to claim 9 wherein:

said top member and said bottom member are attached using pressure sensitive adhesive.

12. A wall covering border according to claim 7, wherein:

said decorated piece is between 6¼" and 6¾" wide.

* * * * *